US005887650A

United States Patent [19]

Yang

[11] Patent Number: 5,887,650

[45] Date of Patent: Mar. 30, 1999

[54] SEALING DEVICE FOR LAMINATED HEAT EXCHANGERS

[75] Inventor: In Chul Yang, Kyungki-do, Rep. of Korea

[73] Assignee: Tai Bong Industries, Inc., Incheon-Si, Rep. of Korea

[21] Appl. No.: 994,131

[22] Filed: Dec. 19, 1997

[30] Foreign Application Priority Data

Jan. 6, 1997 [KR] Rep. of Korea ..... 1997 122

[51] Int. Cl.[6] ..... F28F 3/10

[52] U.S. Cl. ..... 165/166; 165/167

[58] Field of Search ..... 165/166, 167

[56] References Cited

U.S. PATENT DOCUMENTS

| | | | |
|---|---|---|---|
| 3,244,227 | 4/1966 | Usher . | |
| 4,377,204 | 3/1983 | Johansson | 165/166 |
| 4,635,715 | 1/1987 | Andersson | 165/166 |
| 4,905,758 | 3/1990 | Mathur et al. | 165/166 |
| 4,995,455 | 2/1991 | Mathur | 165/166 |

FOREIGN PATENT DOCUMENTS

| | | | |
|---|---|---|---|
| 91-3072 | 5/1991 | Rep. of Korea . | |
| 1430716 | 10/1988 | U.S.S.R. | 165/166 |
| 2069680 | 8/1981 | United Kingdom | 165/166 |

*Primary Examiner*—Leonard R. Leo

*Attorney, Agent, or Firm*—Shlesinger, Arkwright & Garvey LLP

[57] ABSTRACT

A sealing device for laminated heat exchangers is disclosed. The sealing device has a heat exchanging plate including both a wave-shaped portion and a longitudinal groove. The wave-shaped portion having a plurality of alternately arranged depressions and prominences with a hole being formed on the inside wall of each of the depressions while a fitting edge remains at its top side. In addition, the device also has a gasket having a longitudinal body and a plurality of fitting taps. The fitting taps are perpendicularly formed alongside the longitudinal body at regular intervals, individually having a fitting slit at its inside end. A free end part, formed at the inside lower portion of each of the fitting taps, is inserted into the hole of each of the depressions with the fitting slit being fitted over the fitting edge of the heat exchanging plate when the gasket is set on the heat exchanging plate.

3 Claims, 3 Drawing Sheets

【FIG.1】
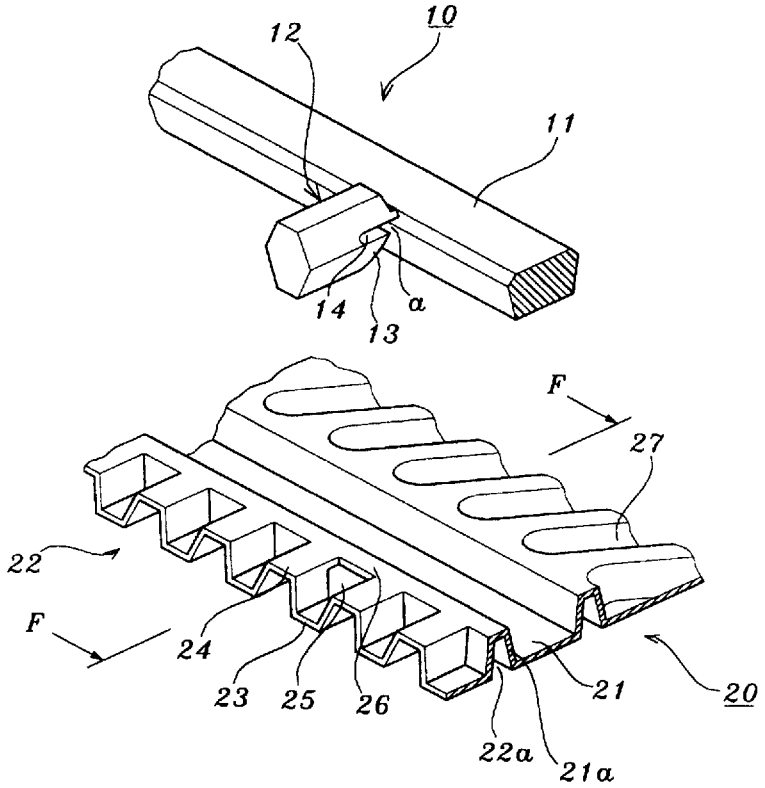
【FIG.2】
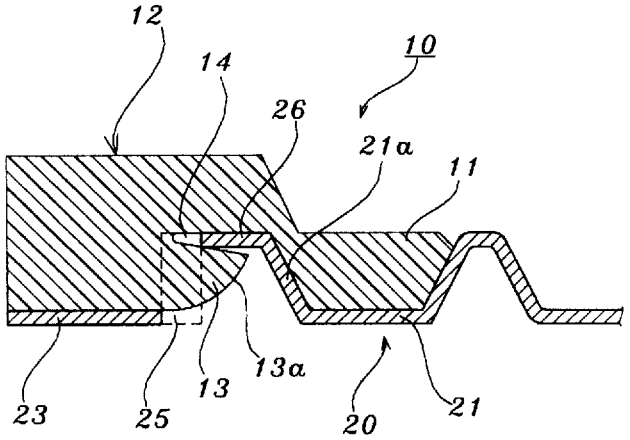

【FIG.3】
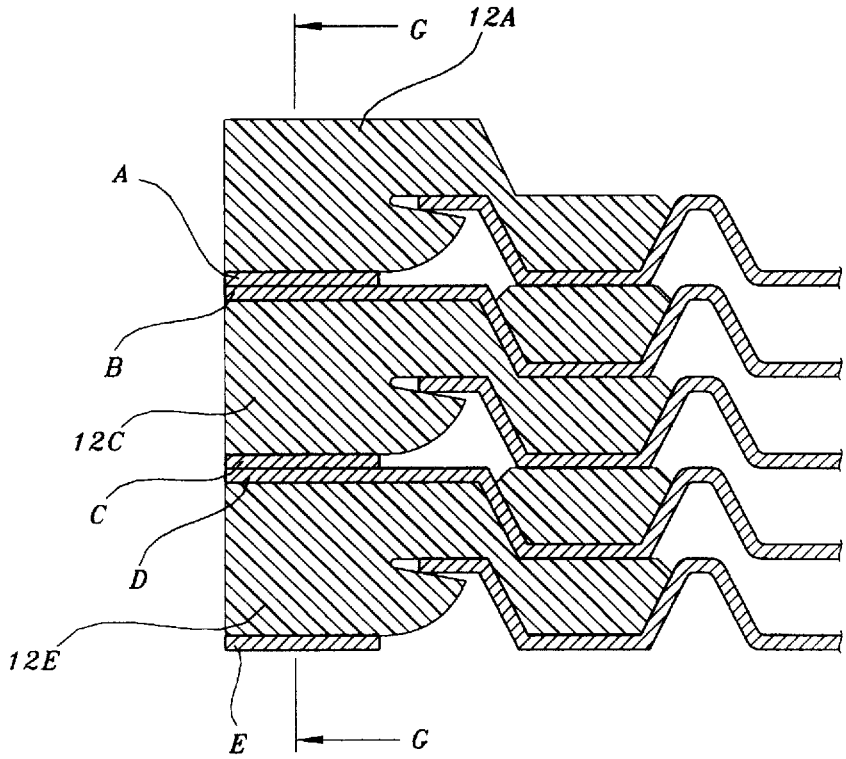
【FIG.4】
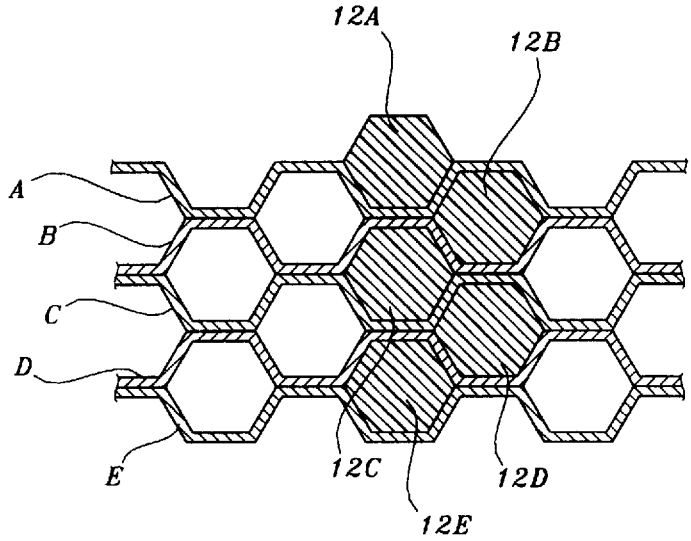

【FIG.5(Prior Art)】
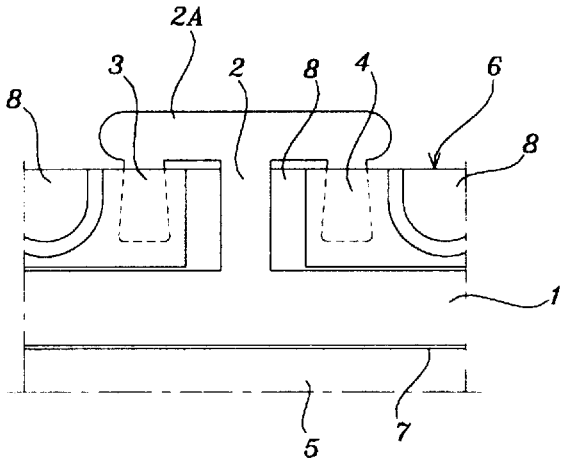
【FIG.6(Prior Art)】
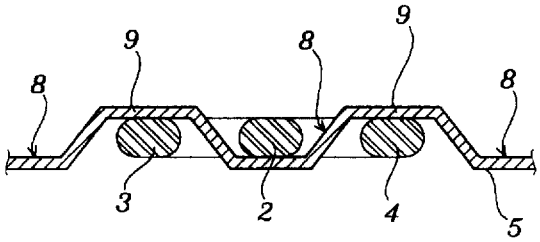

SEALING DEVICE FOR LAMINATED HEAT EXCHANGERS

BACKGROUND OF THE INVENTION

1. Field of the Invention

The present invention relates to, in general, a sealing device for laminated heat exchangers and, more particularly, to a sealing device provided with a gasket capable of preventing heat exchanging mediums from being leaked from the junction between neighbored heat exchanging plates, thereby improving the heat efficiency of a heat exchanger.

2. Description of the Prior Art

As well known to those skilled in the art, a laminated heat exchanger consists of a plurality of heat exchanging plates. The assembling method of such a laminated heat exchanger will be described below. First, a gasket is set on the heat exchanging plate. Thereafter, supporting bars are inserted into holes formed on the heat exchanging plates. Such a plurality of heat exchanging plates, with the supporting bars, are clamped together and so a complete heat exchanger is obtained.

In a conventional method for attaching the gasket to the heat exchanging plate, adhesives are preferentially applied to a longitudinal groove, formed on the edge of the heat exchanging plate, prior to seating the gasket into the groove.

However, such a conventional method is problematic in that the application of the adhesives requires a lot of time and labor. Also, it is difficult to maintain the cleanliness of the adhesive surface of the heat exchanging plate. In addition, the firstly applied adhesives are more quickly hardened than that of the lastly applied adhesives because the adhesives are wholly applied along the lengthy longitudinal grove. Thus, the part of the gasket, located at a position of the primarily hardened adhesives, may be easily separated from the heat exchanging plate. Furthermore, when an existing gasket has to be exchanged with a new one, the adhesives, existing on the heat exchanging plate, have to be removed.

In order to overcome the above problems, a sealing device for such heat exchangers, without using any adhesives, is proposed.

For example, a sealing device for such heat exchangers is disclosed in U.S. Pat. No. 3,244,227 (Apr. 5, 1966). In the above U.S. Patent, the sealing device comprises a heat exchanging plate, having an extended part at its edge, and a gasket, including a fitting tap. Also, a groove is formed around the edge of the heat exchanging plate and so the fitting tap is fitted into the groove. In addition, a plurality of holes are formed on the extended part, while a plurality of pins are formed at the lower portion of the fitting tap. Thus, the pins are effectively inserted into the holes.

However, the above sealing device according to the U.S. Pat. No. 3,244,227 has the following problems. That is, the hole of the heat exchanging plate has the same diameter as the pin of the gasket because the pins of the fitting tap have to be tightly inserted into the holes of the plates. Thus, it is difficult to insert the pins into the holes, thereby reducing work efficiency while assembling the gasket with the heat exchanging plate. On the other hand, when the diameter of the holes is large than that of the pins, the gasket may be easily separated from the heat exchanging plate.

In addition, a sealing device for such heat exchangers is disclosed in U.S. Pat. No. 4,905,758 (Mar. 6, 1990). In the above U.S. Patent, the sealing device comprises a heat exchanging plate, having a groove at its edge, and a gasket, including a fitting tap. Also, step parts are formed at the outer portion of the groove, while a plurality of holes are formed at the side portions of the step parts. Thus, the fitting tap is effectively inserted into the holes.

However, the above sealing device according to the U.S. Pat. No. 4,905,758 has the following problem. That is, the gasket may slip toward the holes because the holes are formed at the side portion of the groove, thereby reducing a sealing effect.

In order to overcome the above problems, a sealing device for heat exchangers is disclosed in Korean Patent Publication No. 91-3072. The sealing device according to the above Korean Patent is schematically shown in FIGS. 5 and 6.

As shown in FIGS. 5 and 6, the sealing device comprises a heat exchanging plate 5 and a gasket 1. The heat exchanging plate 5 includes both a wave-shaped portion at its edge 6 and a longitudinal groove 7 at a position inside the wave-shaped portion. The wave-shaped portion of the plate 5 has a plurality of alternately arranged ridges 9 and furrows 8.

The gasket 1, to be set on the heat exchanging plate 5, has a configuration, which is integrally formed with a connecting part 2, supporting part 2A and two free end parts 3 and 4. One end of the connecting part 2 is perpendicularly formed on the body of the gasket 1, the other end of the connecting part 2 is also perpendicularly connected to the central portion of the supporting part 2A. That is, the supporting part 2A is parallel with the body of the gasket 1.

In addition, the two free end parts 3 and 4 are formed at both ends of the supporting part 2A in such a manner that the two free end parts 3 and 4 vertically extend toward the body of the gasket 1, respectively.

Thus, the gasket 1 is set on the heat exchanging plate 5 in such a manner that the connecting part 2 of the gasket 1 comes into contact with the upper surface of a furrow 8, and the two free end parts 3 and 4 closely come into contact with the lower surfaces of two ridges 9, respectively.

However, the above sealing device for heat exchangers is problematic in that the construction of the gasket 1 is complicated due to the connecting, mounting parts 12 and 12A, and the two free end parts 3 and 4. Also, it is difficult to fit the two free end parts 3 and 4 of the gasket 1 into the lower surfaces of the ridges 9. In addition, when the heat exchanging plate 5 is installed in the heat exchanger, the conventional sealing device requires a space for the supporting part 2A because the supporting part 2A is protruded toward the outside of the heat exchanging plate 5.

SUMMARY OF THE INVENTION

Accordingly, the present invention has been made with the above problems occurring in the prior art in mind, and an object of the present invention is to provide a sealing device for laminated heat exchangers capable of easily setting a gasket onto a heat exchanging plate, thereby improving the sealing effect of a gasket and increasing the thermal efficiency of a heat exchanger.

Another object of the present invention is to provide a sealing device having a configuration, in which the fitting taps of a gasket substantially meet the wave-shaped portions of a heat exchanging plate, thereby correctly locating each of the heat exchanging plates at its position.

In order to accomplish the above objects, the present invention provides a sealing device for laminated heat exchangers, comprising: a heat exchanging plate including both a wave-shaped portion at its edge and a longitudinal groove at a position inside the wave-shaped portion, the wave-shaped portion having a plurality of alternately arranged depressions and prominences with a hole being formed on the inside wall of each of said depressions while a fitting edge remains at its top side; and a gasket having a longitudinal body and a plurality of fitting taps, thus being set on the heat exchanging plate with both the longitudinal body being received in the longitudinal groove and the fitting taps being received in said depressions, the fitting taps being perpendicularly formed alongside the longitudinal body at regular intervals and individually having a fitting slit at its inside end, thus forming a free end part at its inside lower portion, the free end part being inserted into the hole of each of the depressions with the fitting slit being fitted over the fitting edge of said heat exchanging plate when the gasket is set on the heat exchanging plate.

BRIEF DESCRIPTION OF THE DRAWINGS

The above object, and other features and advantages of the present invention will be more clearly understood from the following detailed description taken in conjunction with the accompanying drawings, in which:

FIG. 1 is an exploded perspective view of a sealing device in accordance with the preferred embodiment the present invention;

FIG. 2 is a sectional view of the sealing device taken along the line F—F of FIG. 1;

FIG. 3 is a sectional view showing the laminated state of a plurality of heat exchanging plates according to the embodiment of the present invention;

FIG. 4 is a sectional view of the sealing device taken along the line F—F of FIG. 3;

FIG. 5 is a schematic top view of a sealing device in accordance with the prior art; and FIG. 6 is a schematically sectional view of the sealing device in accordance with the prior art.

DESCRIPTION OF THE PREFERRED EMBODIMENT

FIG. 1 is a view illustrating the construction of a sealing device for laminated heat exchangers in accordance with the present invention.

As shown in FIG. 1, the sealing device of this invention comprises a heat exchanging plate 20, which includes both a wave-shaped portion 22 at its edge and a longitudinal groove 21 at a position inside the wave-shaped portion 22. The sealing device also includes a gasket 10, having both a longitudinal body 11 and a plurality of fitting taps 12.

The wave-shaped portion 22 of the plate 20 has a plurality of alternately arranged depressions 23 and prominences 24. In addition, a plurality of holes 25 are formed on the inside wall 22*a* of the depressions 23, while a fitting edge 26 remains at the top side of each of the depressions 23. The inside wall 22*a* is spaced apart from the side wall 21*a* of the longitudinal groove 21 by a predetermined distance. Also, a plurality of passages 27, as a passage of heat exchanging mediums, are formed in such manner that the passages 27 extend regularly and perpendicularly from the groove 21 of the plate 20.

Thus, the gasket 10 is set on the heat exchanging plate 20 in such manner that both the longitudinal body 11 is received in the longitudinal groove 21 and the fitting taps 12 are received in the depressions 23. The fitting taps 12 are perpendicularly formed alongside the longitudinal body 21 at regular intervals and individually have a fitting slit 14 at its inside end, thereby forming a free end part 13 at its inside lower portion.

When the gasket 10 is set onto the heat exchanging plate 20. Such a free end part 13 is inserted into the hole 25 of each of the depressions 23, while the fitting slits 14 are fitted over the fitting edges 26 of the heat exchanging plate 20. Also, the free end part 13 is upwardly inclined at its bottom surface 13*a*. Preferably, each of the fitting taps 12 has a hexagon-shaped cross-section as shown in FIG. 1.

The mounting method of the sealing device according to the preferred embodiment of this invention will be described below.

First, the body 11 of the gasket 10 is located in the longitudinal groove 21 of the heat exchanging plate 20, while the fitting taps 12 are positioned onto the depressions 23. Thereafter, the free end parts 13 are forcibly inserted into the holes 25 after the fitting taps 12 are manually and slightly lifted. As a result, the upper surfaces of the free end parts 23 come into close contact with the fitting edges 26 of the plate 20 as the fitting slits 14 of the taps 12 are opened, thereby effectively and easily setting the gasket 10 onto the heat exchanging plate 20.

In such a case, due to the elastic force of the free end parts 13 of the fitting taps 12, the fitting edges 26 are tightly fitted into the fitting slits 14. Also, the fitting taps 12 of the gasket 10 are almost completely prevented from being unexpectedly separated from the depressions 23 of the plate 20. That is, when the fitting edges 26 are fitted into the slits 14, such slits 14 are opened and so the bottom surfaces 13*a* of the free end parts 13 push the inside ends of the depressions 23.

In addition, due to the inclined bottom surfaces 13*a* of the free end parts 13, such free end parts 13 are easily inserted into the holes 25 with the fitting taps 12 being downwardly pressed after the free end parts 13 are located at the fitting edges 26 of the heat exchanging plate 20. Therefore, the gasket 10 is tightly and easily set on the heat exchanging plate 20.

As shown in FIGS. 3 and 4, a plurality of support bars (not shown) are inserted into holes (not shown) which are formed on the heat exchanging plate 20 with the gaskets 10. Such a plurality of heat exchanging plates 20, with the supporting bars, are clamped together and so a complete heat exchanger is obtained.

In addition, each of the fitting taps 12A, 12B, 12C, 12D and 12E has a cross section capable of substantially meeting the configuration of each of the depressions at its lower half portion and substantially meeting the configuration of each of the prominences at its upper half portion. Therefore, when a plurality of heat exchanging plates A, B, C, D and E are layered into a laminated heat exchanger, the fitting taps 12A, 12B, 12C, 12D and 12E are tightly surrounded by the depressions and prominences of neighboring heat exchanging plates A, B, C, D and E. Thus, each of the heat exchanging plates is correctly located at its position in a laminated heat exchanger.

Furthermore, due to the honeycomb arrangement of the plates A, B, C, D and E as shown in FIG. 4, any incorrect arrangement of both the heat exchanger plates and the gaskets is easily distinguished in the assembly of the heat exchanging plates. Therefore, the incorrect arrangement of the plates is easily repaired.

In a brief description, the free end parts 13 of the fitting taps 12 of the gasket 10 are easily inserted into the holes 25 of the heat exchanging plate 20. In such a case, the fitting edges 26 of the plate 20 are tightly fitted into the fitting slits 14 of the fitting taps 20.

As mentioned above, the sealing device for laminated heat exchangers of this invention has a configuration capable of tightly sealing heat exchanging plates with gaskets, thereby improving the thermal efficiency of a laminated heat exchanger. In addition, the configuration of the fitting taps of the gasket substantially meets the wave-shaped portions of the heat exchanging plates, thus correctly locating each of the heat exchanging plates at its position in a laminated heat exchanger.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A sealing device for laminated heat exchangers, comprising:

a heat exchanging plate including both a wave-shaped portion at an edge and a longitudinal groove at a position inside the wave-shaped portion, said wave-shaped portion having a plurality of alternately arranged depressions and prominences with a hole being formed on an inside wall of a number of said depressions while a fitting edge remains at a top side thereof; and a gasket having a longitudinal body and a plurality of fitting taps, being set on the heat exchanging plate with both the longitudinal body being received in said longitudinal groove and the fitting taps being received in said depressions, said fitting taps being perpendicularly formed alongside the longitudinal body at regular intervals and individually having a fitting slit at an inside end, forming a free end part at an inside lower portion, said free end part being inserted into the hole of each of said number of depressions with the fitting slit being fitted over the fitting edge of said heat exchanging plate.

2. The device as claimed in claim 1, wherein said free end part is upwardly inclined at a bottom surface thereof.

3. The device as claimed in claim 1, wherein each of said fitting taps has a cross section substantially matching the shape of each of the depressions at a lower half portion and substantially matching the shape of each of the prominences at an upper half portion, wherein the fitting taps are tightly surrounded by the depressions and prominences of two neighboring heat exchanging plates when a plurality of heat exchanging plates are layered into a laminated heat exchanger.

* * * * *